US007784453B1

(12) United States Patent
Yehle

(10) Patent No.: US 7,784,453 B1
(45) Date of Patent: Aug. 31, 2010

(54) DRAW MECHANISM FOR A CROSSBOW

(75) Inventor: Craig T. Yehle, Junction City, OR (US)

(73) Assignee: Extreme Technologies, Inc., Eugene, OR (US)

( * ) Notice: Subject to any disclaimer, the term of this patent is extended or adjusted under 35 U.S.C. 154(b) by 450 days.

(21) Appl. No.: 11/933,394

(22) Filed: Oct. 31, 2007

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS

| | | | | |
|---|---|---|---|---|
| 4,593,675 | A | 6/1986 | Waiser | |
| 4,697,571 | A * | 10/1987 | Waiser | 124/25 |
| 5,115,795 | A * | 5/1992 | Farris | 124/86 |
| 2002/0059924 | A1 | 5/2002 | Bednar | |
| 2004/0194771 | A1 | 10/2004 | Malucelli | |
| 2005/0022799 | A1 | 2/2005 | Bednar | |
| 2006/0086346 | A1 | 4/2006 | Middleton | |
| 2006/0169258 | A1 | 8/2006 | Chang | |

* cited by examiner

*Primary Examiner*—John Ricci
(74) *Attorney, Agent, or Firm*—David S. Alavi

(57) ABSTRACT

A draw mechanism for a crossbow comprises a drive gear, coupling gear, retaining member, one-way rotary clutch, retainer, rotary drive member, tension member, and catch. The drive gear is coupled to the coupling gear. The retaining member and coupling gear are coaxially coupled by the one-way rotary clutch. The retainer releasably engages the retaining member. The coupling gear is coupled to the rotary drive member which is engaged with the tension member. The catch is connected to the tension member and retains a bowstring as the crossbow is drawn. Rotation of the coupling gear in one direction causes the rotary drive member to tension the tension member to move the catch to draw the crossbow. Engagement of the retainer with the retaining member retards rotation of the coupling gear in the other direction thereby retarding movement of the catch to "undraw" the crossbow. Release by the retainer allows movement of the catch to undraw the crossbow.

26 Claims, 4 Drawing Sheets

DRAW MECHANISM FOR A CROSSBOW

BACKGROUND

The field of the present invention relates to crossbows. In particular, a draw mechanism is described herein for a crossbow.

A wide variety of draw mechanisms are available for crossbows. Some of these are described in:

U.S. Pat. No. 4,593,675 entitled "Crossbows" issued Jun. 10, 1986 to Waiser;

U.S. Pub. No. 2002/0059924 A1 entitled "Crossbow bowstring drawing mechanism" published May 23, 2002 in the name of Bednar;

U.S. Pub. No. 2004/0194771 A1 entitled "Automatic cocking device in a crossbow for hunting and archery" published Oct. 7, 2004 in the name of Malucelli;

U.S. Pub. No. 2005/0022799 A1 entitled "Crossbow rope cocking device" published Feb. 3, 2005 in the name of Bednar;

U.S. Pub. No. 2006/0086346 A1 entitled "Crossbow cocking and stringing device" published Apr. 27, 2006 in the name of Middleton; and U.S. Pub. No. 2006/0169258 A1 entitled "Bowstring drawing device for a crossbow" published Aug. 3, 2006 in the name of Chang.

SUMMARY

A draw mechanism for a crossbow comprises a drive gear, a coupling gear, a retaining member, a one-way rotary clutch, a retainer, a rotary drive member, a tension member, and a releasable catch. The drive gear is arranged to be rotated by a user of the crossbow and is coupled to the coupling gear. The retaining member is mounted coaxially with the coupling gear, and the one-way rotary clutch is arranged to couple the retaining member and the coupling gear to allow their relative rotation in a first rotation direction and to substantially prevent their relative rotation in a second rotation direction opposite the first rotation direction. The retainer is arranged to releasably engage the retaining member to substantially prevent rotation of the retaining member when engaged and to permit substantially unrestricted rotation of the retaining member when released. The coupling gear is coupled to the rotary drive member which is in turn engaged with the tension member. The releasable catch is connected to the tension member and arranged to retain a bowstring of the crossbow as it is drawn.

Rotation of the coupling gear in the first rotation direction causes the rotary drive member to tension the tension member to move the catch in a first direction to draw the crossbow. Engagement of the retainer with the retaining member substantially prevents rotation of the coupling gear in the second rotation direction thereby substantially preventing movement of the catch in a second direction opposite the first direction. Release of the retaining member by the retainer allows rotation of the retaining member and the coupling gear in the second rotation direction thereby allowing movement of the catch in the second direction.

Objects and advantages pertaining to crossbow draw mechanisms may become apparent upon referring to the exemplary embodiments illustrated in the drawings and disclosed in the following written description or appended claims.

The embodiments shown in the Figures are exemplary, and should not be construed as limiting the scope of the present disclosure or appended claims.

DETAILED DESCRIPTION OF EMBODIMENTS

Figure 1:
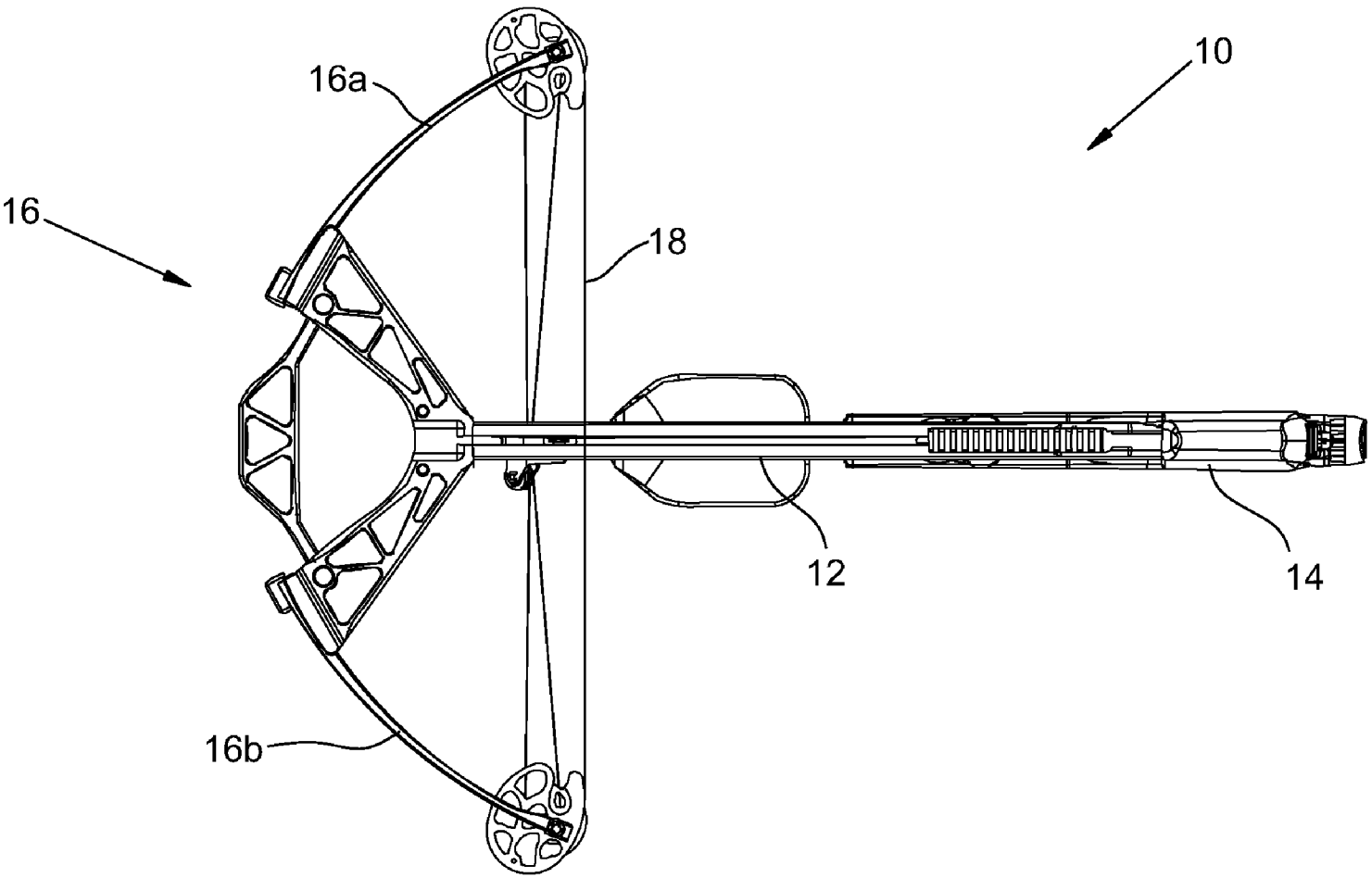
FIGS. 1 and 2 are top and left side views, respectively, of an exemplary crossbow.
Figure 2:
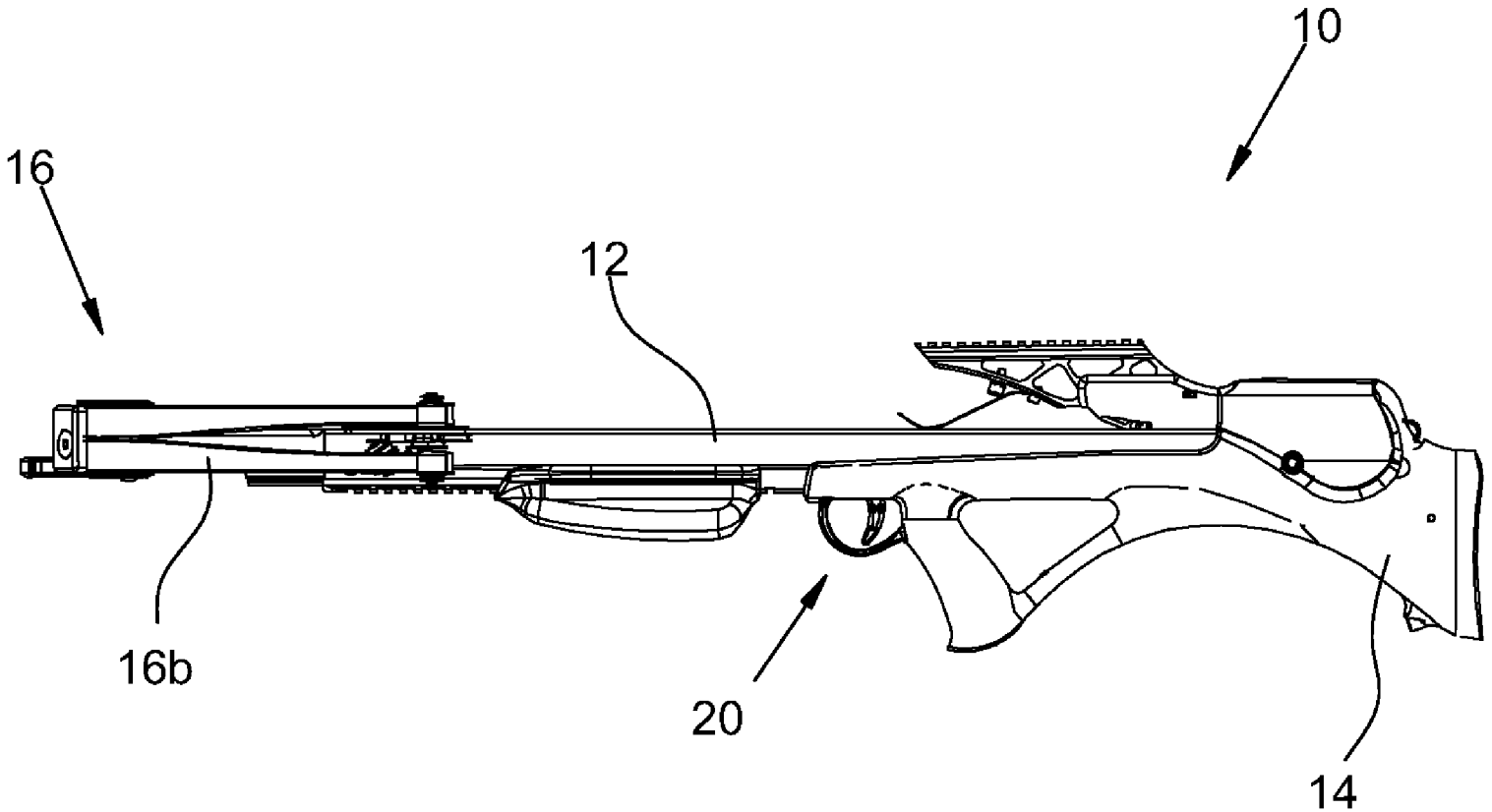

FIGS. 1 and 2 show an exemplary crossbow 10 comprising a barrel 12, a stock 14 connected to the barrel 12 at the rear of the crossbow 10, a bow 16 connected to the barrel 12 at the front of the crossbow 10, a bowstring 18 (also referred to as a draw cable) connected to the bow 16, and a trigger mechanism 20. The bow 16 comprises a pair of bow limbs **16*a* and 16*b*. In the example shown each bow limb comprises a pair of limb members, however, each limb can instead comprise a single limb member. The exemplary crossbow 10 shown in the drawings is a compound bow with a pair of pulley members and additional cables, however, any type of crossbow (simple, recurve, reflex, single-cam compound, dual-cam compound, hybrid-cam compound, and so on) shall fall within the scope of the present disclosure or appended claims. Numerous details of the construction of the compound bow 10** can vary considerably while remaining within the scope of the present disclosure or appended claims, and all such variations need not be enumerated herein.

Figure 3:
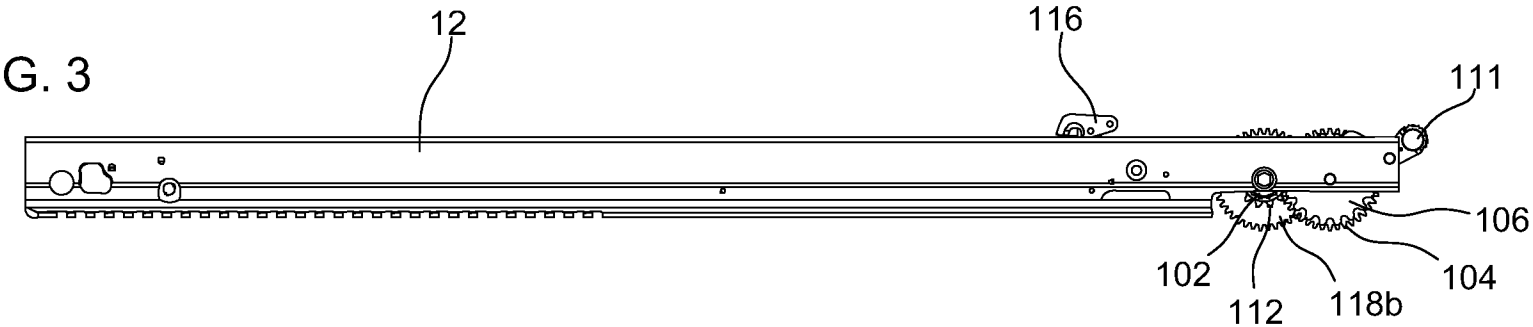
FIG. 3 is a left side view of a barrel and draw mechanism of an exemplary crossbow.
Figure 4:
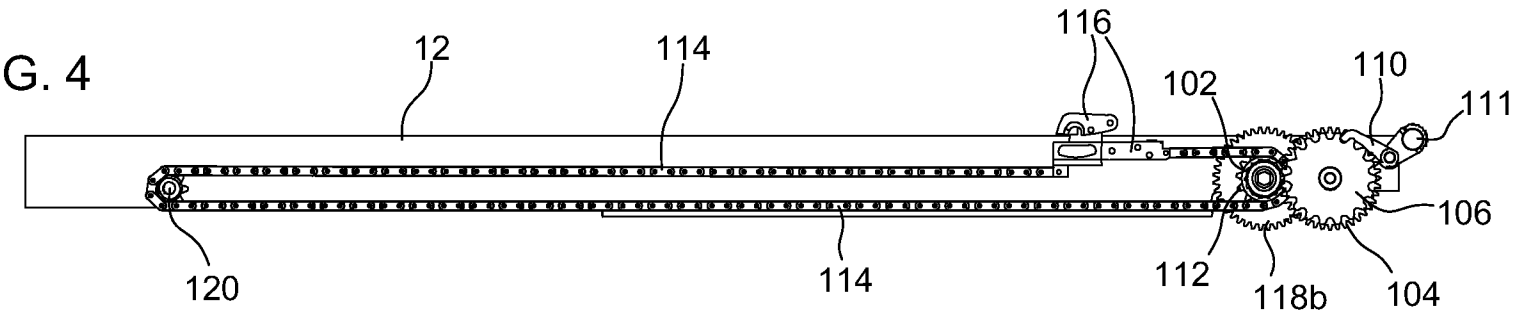
FIG. 4 is a left side cut-away view of a barrel and draw mechanism of an exemplary crossbow.
Figure 5:
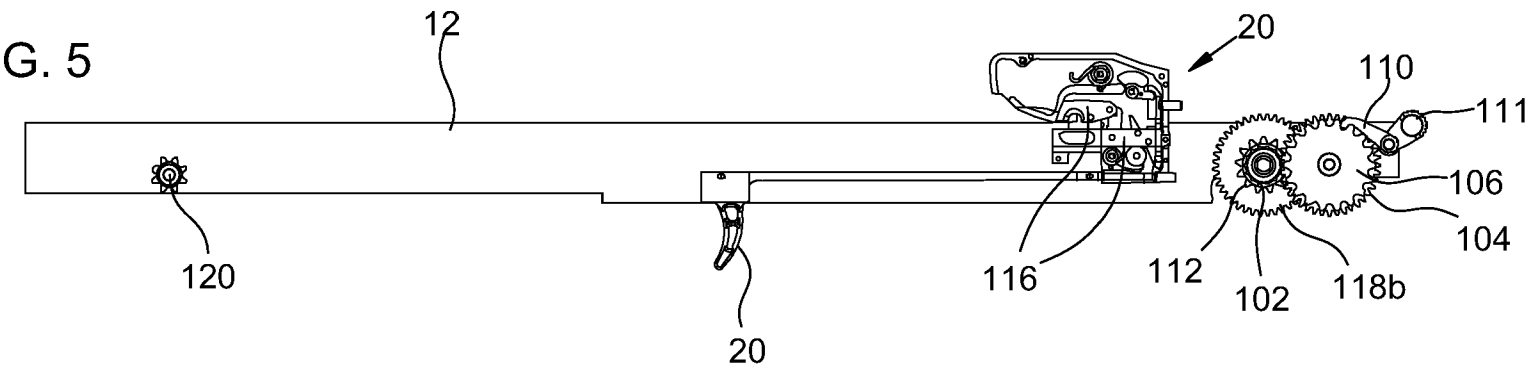
FIG. 5 is a left side cut-away view of a barrel, draw mechanism, and trigger mechanism of an exemplary crossbow.
Figure 6:
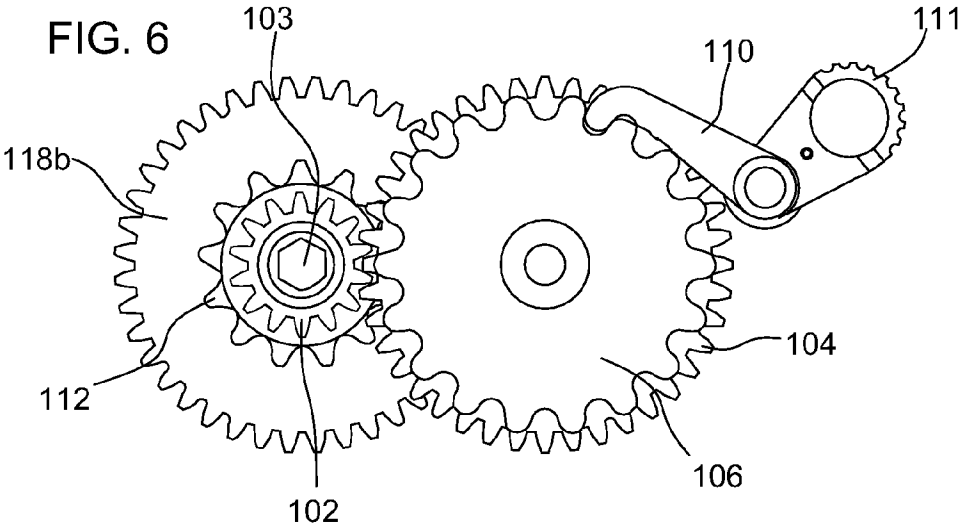
FIGS. 6, 7, and 8 are left, right, and top views, respectively, of a gear assembly of an exemplary draw mechanism for a crossbow.
Figure 7:
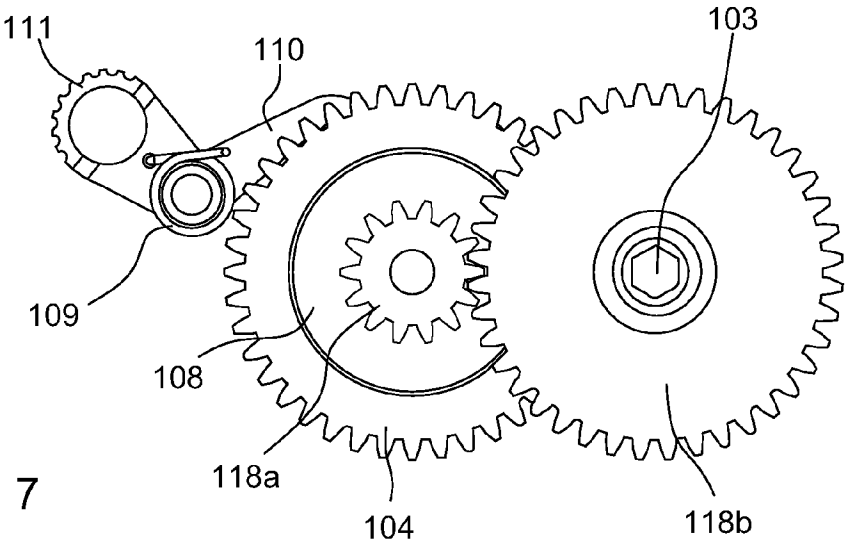
Figure 8:
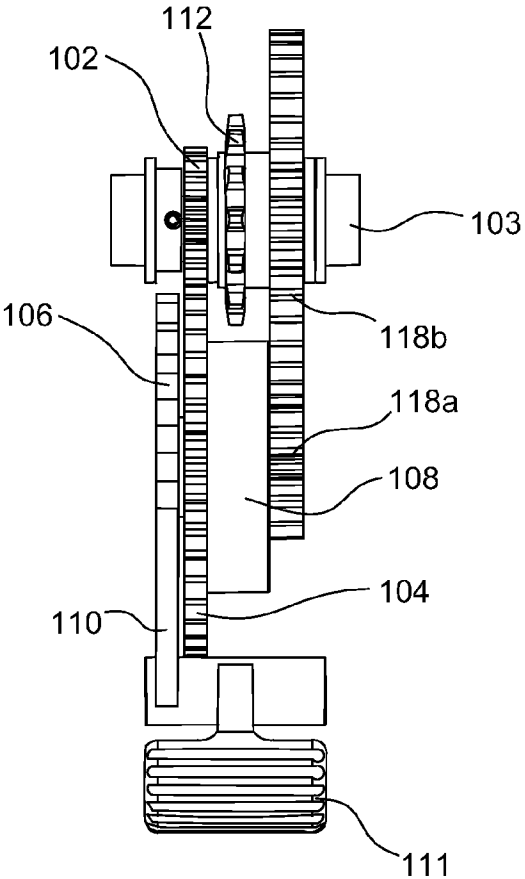

The crossbow 10 further comprises a draw mechanism (not visible in FIGS. 1 and 2. An exemplary draw mechanism is shown in FIGS. 3 and 4 with only the barrel 12 of crossbow 10, and shown in FIG. 5 with barrel 12 and trigger mechanism 20. FIGS. 6-8 show a gear assembly for the exemplary draw mechanism. The exemplary draw mechanism comprises a drive gear 102, a coupling gear 104, a retaining gear 106, a one-way rotary clutch 108, a pawl 110, a drive sprocket 112, a chain 114, and a releasable catch 116.

The drive gear 102 is arranged to be rotated by a user of the crossbow 10 and is coupled to the coupling gear 104. In the exemplary embodiment the drive gear 102 is mounted on a shaft 103 that can be rotated by a user with a crank handle (detachable; not shown). Any suitable mechanism or arrangement for enabling the drive gear 102 to be rotated by a user of a crossbow (e.g., shaft, crank, handle, lever, motor, and so on) shall fall within the scope of the present disclosure. In the exemplary embodiment the drive gear 102 is coupled to the coupling gear 104 by direct engagement of the teeth of the respective gears. The coupling gear diameter is larger than the drive gear diameter in this example, resulting in a mechanical advantage for rotating the coupling gear 104. Any suitable relative diameters can be employed for the drive and coupling gears 102 and 104. The drive gear 102 and coupling gear 104 can also be coupled indirectly, e.g., by a reduction gear pair (not shown). Any suitable mechanism or arrangement can be employed for coupling the drive and coupling gears 102 and 104.

The retaining gear 106 is mounted coaxially with the coupling gear 104. The one-way rotary clutch 108 is arranged to couple the retaining gear 106 and the coupling gear 104 to allow their relative rotation in a first rotation direction (e.g., with the coupling gear 104 rotating counter-clockwise relative to the retaining gear 106 in FIGS. 3-6, i.e., when viewed from the left side of the exemplary crossbow) and to substantially prevent their relative rotation in the opposite direction (e.g., preventing the coupling gear 104 from rotating clockwise relative to the retaining gear 106 in FIGS. 3-6). The one-way rotary clutch 108 can comprise a roller clutch, a sprag clutch, or other functionally equivalent mechanism. Examples of a roller clutch can be found in, e.g., U.S. Pat. No. 7,147,091, U.S. Pat. No. 5,819,899, U.S. Pat. No. 5,740,893, U.S. Pat. No. 3,104,744, U.S. Pat. No. 2,292,988, or U.S. Pat. No. 1,337,634. Examples of a sprag clutch can be found in, e.g., U.S. Pat. No. 6,059,084, U.S. Pat. No. 5,960,917, U.S. Pat. No. 4,546,864, U.S. Pat. No. 3,066,779, U.S. Pat. No. 2,954,855, or U.S. Pat. No. 2,599,793. Each of said patents is incorporated by reference as if fully set forth herein. The one-way rotary clutch 108 can comprise any of the cited examples or any other suitable functionally equivalent mechanism.

The one-way rotary clutch 108 can be substantially silent in its operation as it allows the coupling gear 104 to rotate relative to the retaining gear 106. This substantially silent operation contrasts the relatively noisy operation of a ratchet-type mechanism, for example, as the pawl of such a ratchet mechanism clicks against each successive tooth of the ratchet. Substantially silent operation of the one-way clutch 108 can prove advantageous in a hunting situation, for example, when any noise produced by the crossbow might scare off a potential target animal. A roller clutch or a sprag clutch can provide the desired substantially silent operation during relative rotation of the coupling gear 104 and the retaining gear 106.

The pawl 110 is arranged to releasably engage the retaining gear 106 to substantially prevent rotation (in either direction) of the retaining gear 106 when engaged and to permit substantially unrestricted rotation (in either direction) of the retaining gear 106 when released. In the exemplary embodiment the pawl 110 is resiliently biased (by a torsion spring 109) into engagement with the retaining gear 106. A user can press the lever portion 111 of the pawl 110 to rotate it against its bias to disengage it from the retaining gear 106. Any suitable arrangement of the pawl 110 and the retaining gear 106 can be employed.

Instead of retaining gear 106, any other suitable retaining member can be coupled to the coupling gear 104 by the one-way clutch 108. Instead of pawl 110, any other suitable retainer can be arranged to releasably engage such a retaining member to retard or prevent its rotation when engaged and to permit substantially unrestricted rotation of the retaining member when disengaged. In one alternative example (not shown), the retaining member and retainer can comprise a pair of friction disks, with one friction disk acting as the retaining member coupled to the coupling gear 104 through the one-way clutch 108 and with the other friction disk acting as the retainer arranged to be releasably engaged with the first friction disk (by spring loaded engagement or other suitable arrangement). Any other suitable mechanism or arrangement can be employed for the retaining member and the releasably engaged retainer within the scope of the present disclosure or appended claims.

The coupling gear 104 is coupled to the drive sprocket 112. In one example (not shown), the coupling gear 104 and the drive sprocket 112 can be coupled to rotate together on a common shaft (by being integrally formed, by each being fixed to the common shaft, or by any other suitable arrangement). In another example (shown in the drawings), the coupling gear 104 and the drive sprocket 112 can be coupled through a reduction gear pair 118*a* and 118*b*. In the illustrated example, coupling gear 104 and reduction gear 118*a* are coupled to rotate together on a common shaft (by being integrally formed, by each being fixed to the common shaft, or by any other suitable arrangement), and drive sprocket 112 and reduction gear 118*b* are coupled to rotate together on another shaft (by being integrally formed, by each being fixed to the common shaft, or by any other suitable arrangement). In the exemplary arrangement shown in the drawings, the drive sprocket 112 and the reduction gear 118*b* rotate together on shaft 103 independently of the shaft 103 and the drive gear 102; such an arrangement enables a more compact arrangement of the draw mechanism. Other suitable arrangements can be employed. The reduction gear pair 118*a* and 118*b* are directly coupled to one another through engagement of their gear teeth in the exemplary embodiment, but can instead be coupled by additional intervening gears if needed or desired. In the illustrated example, the diameter of reduction gear 118*a* is smaller than that of coupling gear 104 and reduction gear 118*b*, and the diameter of reduction gear 118*b* is larger than that of drive sprocket 112. These relative diameters yield a mechanical advantage for driving the drive sprocket 112. Any suitable combination of gear diameters can be employed as needed or desired. Any suitable mechanism or arrangement can be employed for coupling the coupling gear 104 and the drive sprocket 112.

The drive sprocket 112 is engaged with the chain 114. The releasable catch 116 moves along the barrel 12 and is connected to the chain 114. The catch 116 is arranged to retain the bowstring 18 of the crossbow 10 as it is drawn. The catch 116 can take any suitable form, including a hook, a claw, a caliper as shown in the drawings or in co-pending U.S. non-provisional application Ser. No. 11/763,155 (incorporated by reference as if fully set forth herein), or any other form suitable for retaining the bowstring 18 as the crossbow 10 is drawn. In one example (not shown), the catch 116 can be arranged to release the drawn bowstring 18 after it has be positioned to be retained by the trigger mechanism of the crossbow and after said trigger mechanism has been engaged to retain the drawn bowstring 18. In another example (illustrated in the drawings), the catch 116 becomes operatively coupled to the trigger mechanism 20 when the bowstring 18 is drawn. Actuation of the trigger mechanism 20 causes the catch 116 to release the drawn bowstring 18, thus shooting the crossbow.

Instead of drive sprocket 112, any other suitable rotary drive member can be employed, e.g., a sprocket, a pulley, or other suitable rotary drive member. Instead of chain 114, any other suitable tension member can be engaged with the rotary drive member and connected to the catch 116, e.g., a chain, a cable, a belt, a ribbon, or other suitable tension member.

To draw the crossbow 10, the bowstring is first engaged with the catch 116 (initially positioned toward the front of the barrel). With the bowstring retained by the catch 116, a user of the crossbow 10 rotates the drive gear 102 (by a hand crank or other mechanism) to rotate the coupling gear 104 in the first rotation direction. The draw mechanism is arranged so that rotation of the coupling gear 104 in the first rotation direction causes the drive sprocket 112 to tension the chain 114 to move the catch 116 rearward along the barrel 12 of the crossbow 10. Engagement of the pawl 110 with the retaining gear 106 substantially prevents rotation of the coupling gear 104 in the second rotation direction (due to the coupling of the one-way clutch 108), thereby substantially preventing movement of the catch 116 back toward the front of the crossbow 10 under the tension of the drawn bowstring 18. The user continues to rotate the drive gear 102 until the crossbow 10 is fully drawn and ready to be loaded and shot. The trigger mechanism 20 can optionally include a safety feature to prevent shooting the drawn crossbow without a bolt loaded (for example, as taught in said application Ser. No. 11/763,155).

Release of the retaining gear 106 by the pawl 110 allows rotation of the retaining gear 106 and the coupling gear 104 in the second rotation direction thereby allowing movement of the catch 116 forward along the barrel 12 of the crossbow 10. In the example shown, the user presses lever portion 111 of the pawl 110 to disengage it from the retaining gear 106. Any other suitable disengagement mechanism can be employed. The pawl can be thus released and the drive gear 102 rotated (in reverse, i.e., in the opposite direction of that used to draw the crossbow) to allow the carrier 116 after shooting the crossbow to return toward the front of the barrel 12 to prepare for the next draw. Alternatively, if the user wishes not to fire the drawn crossbow, the pawl 110 can be released and the drive gear 102 rotated in reverse to safely allow the carrier 116 to move forward along the barrel 12 and to release the tension on the drawn bowstring 18. This latter capability is often lacking in prior crossbows.

The crossbow can further comprise an idler sprocket 120 engaged with the chain 114, and chain 114 can form a closed loop (with catch 116 incorporated into the looped chain 114, as in the drawings, or with catch 116 attached to the looped chain 114). With the pawl 110 released and the drive gear 102 rotated in reverse, the looped chain 114 is tensioned to move the catch 116 forward along the barrel to prepare for the next draw. Such a looped arrangement also eliminates the need for a chain take-up mechanism as the catch 116 is drawn backward along the barrel 12 of the crossbow 10. If an alternative tension member is employed (cable, belt, ribbon, and so on), then a suitable alternative idler member can be employed as well.

The draw mechanism can be arranged on or in the crossbow 10 in any suitable, needed, or desired configuration. It can be advantageous to enclose a portion of the draw mechanism 10. In the exemplary embodiment shown, the drive gear 102, the coupling gear 104, the one-way rotary clutch 108, the retaining gear 106, the drive sprocket 112, and the chain 114 are enclosed within the stock 14 or the barrel 12. Other suitable arrangements shall fall within the scope of the present disclosure or appended claims.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

What is claimed is:

1. A draw mechanism for a crossbow, the draw mechanism comprising:

a drive gear arranged to be rotated by a user of the crossbow;

a coupling gear coupled to the drive gear;

a retaining member mounted coaxially with the coupling gear;

a one-way rotary clutch arranged to couple the retaining member and the coupling gear to allow their relative rotation in a first rotation direction and to substantially prevent their relative rotation in a second rotation direction opposite the first rotation direction;

a retainer arranged to releasably engage the retaining member to retard or prevent rotation of the retaining member when engaged and to permit substantially unrestricted rotation of the retaining member when released;

a rotary drive member coupled to the coupling gear;

a tension member engaged with the rotary drive member; and a releasable catch connected to the tension member and arranged to retain a bowstring of the crossbow as it is drawn, wherein the draw mechanism is further arranged so that:

rotation of the coupling gear in the first rotation direction causes the rotary drive member to tension the tension member to move the catch in a first direction to draw the crossbow;

engagement of the retainer with the retaining member substantially retards or prevents rotation of the coupling gear in the second rotation direction thereby retarding or preventing movement of the catch in a second direction opposite the first direction; and release of the retaining member by the retainer allows rotation of the retaining member and the coupling gear in the second rotation direction thereby allowing movement of the catch in the second direction.

2. The draw mechanism of claim 1 wherein the retaining member comprises a retaining gear and the retainer comprises a pawl arranged to releasably engage the retaining gear to substantially prevent rotation of the retaining gear when engaged and to permit substantially unrestricted rotation of the retaining gear when released.

3. The draw mechanism of claim 1 wherein the rotary drive member comprises a drive sprocket and the tension member comprises a chain engaged with the drive sprocket.

4. The draw mechanism of claim 1 wherein relative rotation of the coupling gear and the retaining member in the first rotation direction is substantially silent.

5. The draw mechanism of claim 1 wherein the one-way rotary clutch comprises a roller clutch or a sprag clutch.

6. The draw mechanism of claim 1 further comprising an idler member engaged with the tension member, wherein (i) the tension member or (ii) the tension member and the catch form a closed loop, so that rotation of the coupling gear in the second rotation direction causes the rotary drive member to tension the tension member to move the catch in the second direction.

7. The draw mechanism of claim 6 wherein the rotary drive member comprises a drive sprocket, the idler member comprises an idler sprocket, and the tension member comprises a chain engaged with the drive sprocket and the idler sprocket.

8. The draw mechanism of claim 1 wherein the diameter of the coupling gear is greater than the diameter of the drive gear.

9. The draw mechanism of claim 1 further comprising at least one reduction gear pair coupling (i) the drive gear and the coupling gear or (ii) the coupling gear and the rotary drive member.

10. The draw mechanism of claim 1 wherein the catch is arranged to release the drawn bowstring to shoot the crossbow in response to actuation of a trigger mechanism of the crossbow.

11. The draw mechanism of claim 1 wherein the catch is arranged (i) to position the drawn bowstring to be retained by a trigger mechanism of the crossbow, and (ii) to release the drawn bowstring retained by the trigger mechanism.

12. A crossbow incorporating the draw mechanism of claim 1, further comprising:

a barrel;

a stock connected to the barrel at the rear of the crossbow;

a bow connected to the barrel at the front of the crossbow and comprising two bow limbs;

a bowstring connected to the bow limbs; and a trigger mechanism, wherein:

the draw mechanism is arranged on the crossbow to draw the bowstring in the first direction rearward along the barrel.

13. The crossbow of claim 12 wherein the drive gear, the coupling gear, the one-way rotary clutch, the retaining member, the rotary drive member, and the tension member are enclosed within the stock or the barrel.

14. A method for making a draw mechanism for a crossbow, the method comprising:

arranging a drive gear to be rotated by a user of the crossbow;

coupling a coupling gear to the drive gear;

mounting a retaining member coaxially with the coupling gear;

arranging a one-way rotary clutch to couple the retaining member and the coupling gear to allow their relative rotation in a first rotation direction and to substantially prevent their relative rotation in a second rotation direction opposite the first rotation direction;

arranging a retainer to releasably engage the retaining member to retard or prevent rotation of the retaining member when engaged and to permit substantially unrestricted rotation of the retaining member when released;

coupling a rotary drive member to the coupling gear;

engaging a tension member with the rotary drive member;

connecting a releasable catch to the tension member and arranging the releasable catch to retain a bowstring of the crossbow as it is drawn;

arranging the draw mechanism so that rotation of the coupling gear in the first rotation direction causes the rotary drive member to tension the tension member to move the catch in a first direction to draw the crossbow;

arranging the draw mechanism so that engagement of the retainer with the retaining member retards or prevents rotation of the coupling gear in the second rotation direction thereby retarding or preventing movement of the catch in a second direction opposite the first direction; and arranging the draw mechanism so that release of the retaining member by the retainer allows rotation of the retaining member and the coupling gear in the second rotation direction thereby allowing movement of the catch in the second direction.

15. The method of claim 14 wherein the retaining member comprises a retaining gear and the retainer comprises a pawl arranged to releasably engage the retaining gear to substantially prevent rotation of the retaining gear when engaged and to permit substantially unrestricted rotation of the retaining gear when released.

16. The method of claim 14 wherein the rotary drive member comprises a drive sprocket and the tension member comprises a chain engaged with the drive sprocket.

17. The method of claim 14 wherein relative rotation of the coupling gear and the retaining member in the first rotation direction is substantially silent.

18. The method of claim 14 wherein the one-way rotary clutch comprises a roller clutch or a sprag clutch.

19. The method of claim 14 further comprising engaging an idler member with the tension member, wherein (i) the tension member or (ii) the tension member and the catch form a closed loop, so that rotation of the coupling gear in the second rotation direction causes the rotary drive member to tension the tension member to move the catch in the second direction.

20. The method of claim 19 wherein the rotary drive member comprises a drive sprocket, the idler member comprises an idler sprocket, and the tension member comprises a chain engaged with the drive sprocket and the idler sprocket.

21. The method of claim 14 wherein the diameter of the coupling gear is greater than the diameter of the drive gear.

22. The method of claim 14 further comprising coupling, using at least one reduction gear pair, (i) the drive gear and the coupling gear or (ii) the coupling gear and the rotary drive member.

23. The method of claim 14 further comprising arranging the catch to release the drawn bowstring to shoot the crossbow in response to actuation of a trigger mechanism of the crossbow.

24. The method of claim 14 further comprising arranging the catch (i) to position the drawn bowstring to be retained by a trigger mechanism of the crossbow, and (ii) to release the drawn bowstring retained by the trigger mechanism.

25. A method for making a crossbow incorporating the method of claim 14 and further comprising:

providing a barrel for the crossbow;

connecting a stock to the barrel at the rear of the crossbow;

connecting a bow to the barrel at the front of the crossbow, the bow comprising two bow limbs;

connecting a bowstring to the bow limbs;

providing a trigger mechanism for the crossbow; and arranging the draw mechanism on the crossbow to draw the bowstring in the first direction rearward along the barrel.

26. The method of claim 25 further comprising enclosing the drive gear, the coupling gear, the one-way rotary clutch, the retaining member, the rotary drive member, and the tension member within the stock or the barrel.

* * * * *